United States Patent [19]

Krent

[11] 4,393,631

[45] Jul. 19, 1983

[54] THREE-DIMENSIONAL ACOUSTIC CEILING TILE SYSTEM FOR DISPERSING LONG WAVE SOUND

[76] Inventor: Edward D. Krent, 207 W. Eisenhower Dr., Sharon, Mass. 02067

[21] Appl. No.: 212,599

[22] Filed: Dec. 3, 1980

[51] Int. Cl.[3] ..... E04B 1/82

[52] U.S. Cl. ..... 52/144; 52/39; 181/286

[58] Field of Search ..... 52/144, 39, 484, 145; 181/286

[56] References Cited

U.S. PATENT DOCUMENTS

| | | | |
|---|---|---|---|
| 2,410,413 | 11/1946 | Hurley | 52/144 X |
| 2,796,636 | 6/1957 | Heerwagen | 52/144 |
| 3,182,747 | 5/1965 | Wilhelmi et al. | 52/144 X |
| 3,239,973 | 3/1966 | Hannes et al. | 52/144 |
| 4,261,433 | 4/1981 | Propst | 181/286 |

*Primary Examiner*—J. Karl Bell

*Attorney, Agent, or Firm*—Weingarten, Schurgin, Gagnebin & Hayes

[57] ABSTRACT

An acoustic ceiling tile system is provided with individual tiles contoured in three dimensions in order to disperse sound energy over the entire audible range human hearing while also absorbing energy from the short and medium wavelength portions of the audible range. In a preferred embodiment, the individual tiles each comprise a peripheral flat portion of size and shape for fitting into a standard suspended ceiling structural grid and an interior convex portion, preferably in the shape of sinusoidal curveloid, for dispersing sound.

25 Claims, 9 Drawing Figures

THREE-DIMENSIONAL ACOUSTIC CEILING TILE SYSTEM FOR DISPERSING LONG WAVE SOUND

FIELD OF THE INVENTION

This invention relates to an improved acoustic ceiling tile system. More particularly, it relates to an acoustic ceiling tile system wherein the individual tiles are contoured in three dimensions in order to disperse sound energy over the entire audible range while absorbing energy in the short and medium wavelength portions of the range.

BACKGROUND OF THE INVENTION

The ceiling is the most important surface in a room for the control of sound. If the ceiling is a hard, sound-reflecting material such as wood, plaster or concrete, sounds will spread throughout the room with little or no reduction; and noise levels will build up.

To minimize such build-up, it is common practice to make ceilings of sound absorbing material such as acoustical tiles. Such tiles are typically flat squares of porous material dimensioned to fit within the openings of a standard suspended ceiling structural grid. Because of their porous nature, the tiles are particularly effective for trapping and absorbing medium wavelength sound between about 1 kilohertz and 2 kilohertz, a narrow band of the audible sound spectrum.

While conventional planar acoustic ceiling systems work well in limiting medium wavelengths of the audible range, they leave much to be desired where there is substantial sound in the range between 4 kilohertz and 8 kilohertz and 100 hertz to 800 hertz. Such longer wavelength sound, encountered in many office and industrial applications, is not easily trapped or absorbed; and portions of it penetrate the planar ceiling system while other portions reflect from the ceiling in a coherent wavefront.

Anechoic chambers have been designed with relatively complex geometries for absorbing the full spectrum of sound (including inaudible wavelengths). These systems, however, are not generally suitable for economical manufacture, installation or use in commercial applications; and they are not suitable for retrofit into existing ceiling systems. Moreover, such totally non-reflective acoustic surfaces would be undesirable in occupied buildings.

SUMMARY OF THE INVENTION

In accordance with the invention, an acoustic ceiling tile system is provided with individual tiles contoured in three dimensions in order to disperse sound energy over the entire audible range of human hearing while also absorbing energy from the short and medium wavelength portions of the audible range. In a preferred embodiment the individual tiles each comprise a peripheral flat portion of size and shape for fitting into a standard suspended ceiling structural grid and an interior convex portion, preferably in the shape of sinusoidal curveloid, for dispersing sound.

BRIEF DESCRIPTION OF THE DRAWINGS

The nature, advantages and various additional features of the invention will appear more fully upon consideration of the illustrative embodiments now to be described in detail in connection with the accompanying drawings.

In the drawings.

For convenience of reference, the same reference numerals are used to indicate the same structural features throughout the drawings.

DETAILED DESCRIPTION OF THE DRAWINGS

A. Illustration of the Operative principles (FIGS. 1 and 1A)

Figure 1A:
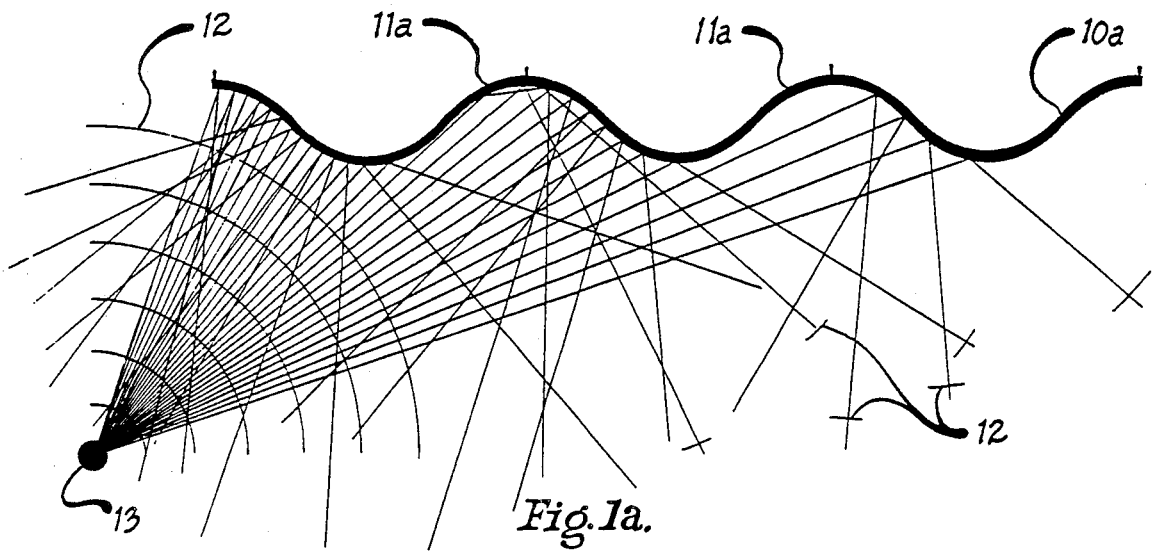
FIGS. 1 and 1*a* are simplified two-dimensional diagrams comparing the effect on long wavelength sound of conventional ceiling systems and ceiling systems according to the invention, respectively.
Figure 1:
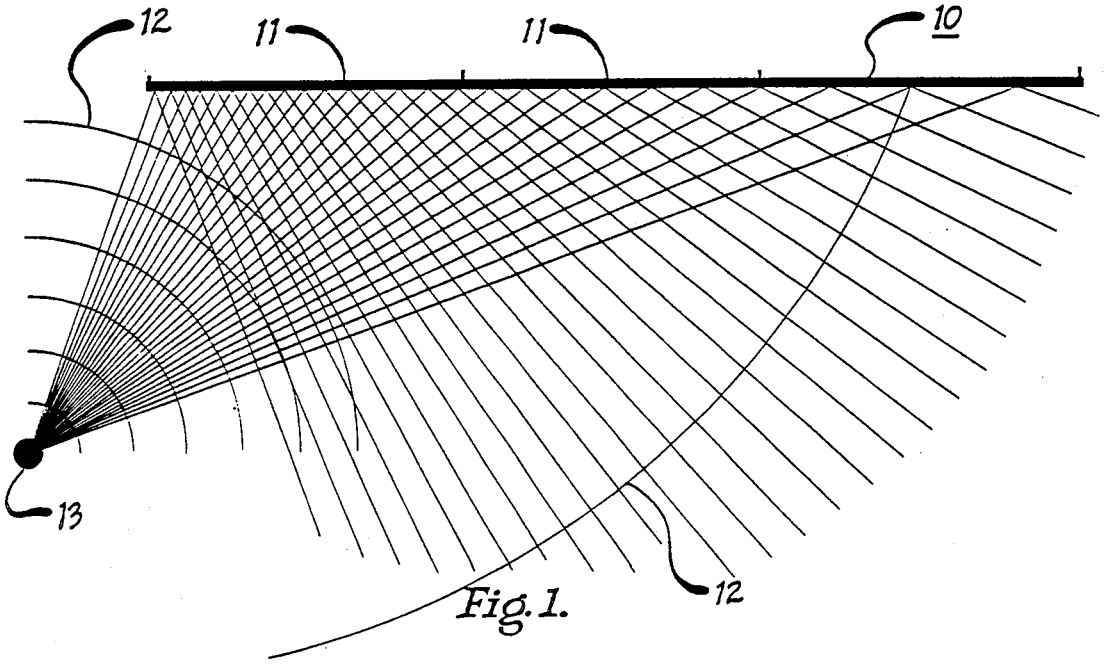

Referring to the drawings, FIGS. 1 and 1*a* are simplified, two-dimensional diagrams useful in explaining operative principles of the invention.

FIG. 1 is a simplified illustration showing the effect of a conventional planar ceiling system 10 comprised of conventional acoustic tiles 11 on the incoming wavefront 12 of long wavelength audible sound from a source 13. As can be seen, the reflected wavefront 12 is substantially undisturbed.

FIG. 1*a* is a simplified illustration showing the effect of a contoured ceiling system 10*a* in accordance with the invention on the wavefront of long wave sound. Here the ceiling comprises an arrangement of contoured acoustic tiles 11*a* arranged to define periodically projecting regions. As can be seen, the projecting regions break up the wavefront so that the sound is greatly dispersed after reflection.

In actual embodiments, tiles in accordance with the invention are contoured in three dimensions rather than two so that dispersion is omni-directional due to the compound curvature.

B. Preferred Embodiment of Ceiling Tile System (FIGS. 2, 3 and 3a)

Figure 2:
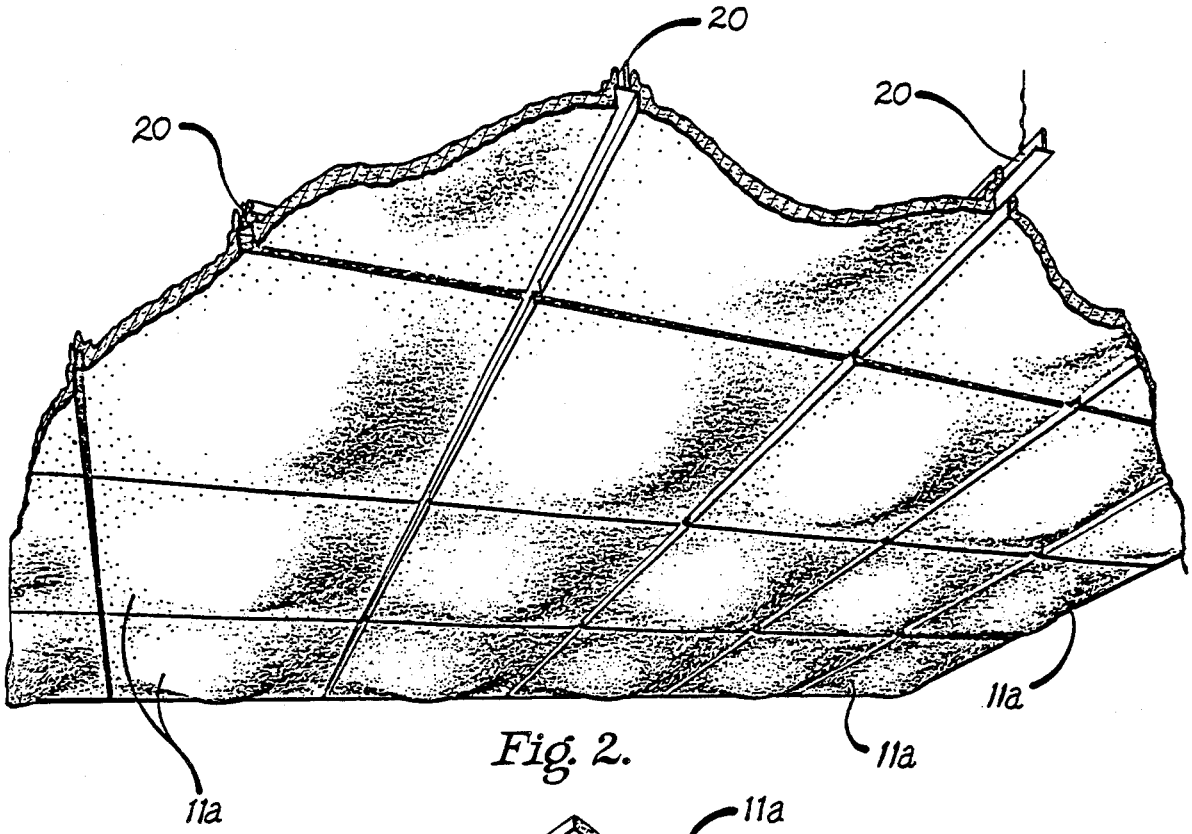
FIG. 2 illustrates a preferred three dimensional contoured ceiling system in accordance with the invention.

FIG. 2 illustrates a preferred embodiment of the invention comprising a ceiling system made up of a plurality of three-dimensionally contoured acoustic tiles 11*a* arranged in a two dimensional array for presenting a sound wavefront with a series of compound curves in all directions over the ceiling. In this preferred arrangement, the acoustic tiles are contoured in the form of sinusoidal curveloids convex towards the floor, and they are arranged in a square grid array. Preferably the tiles fit within the openings of a standard structural grid 20 having regular openings to receive and support ceiling tile.

Figure 3:
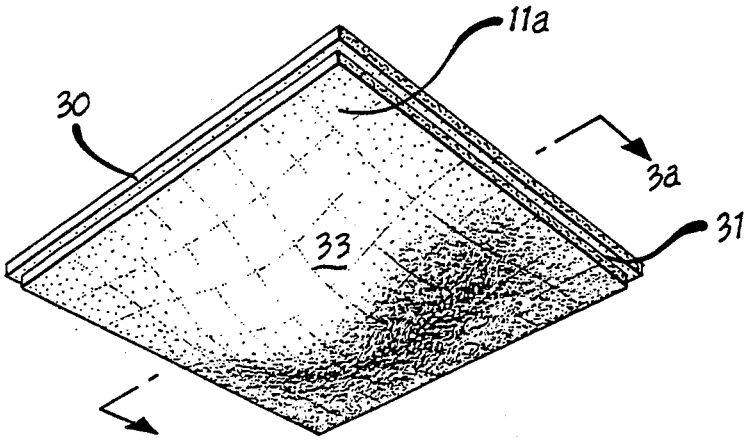
FIGS. 3 and 3*a* are perspective and cross sectional views, respectively, of a preferred sinusoidally contoured acoustic tile for use in the embodiment of FIG. 2.
Figure 3A:
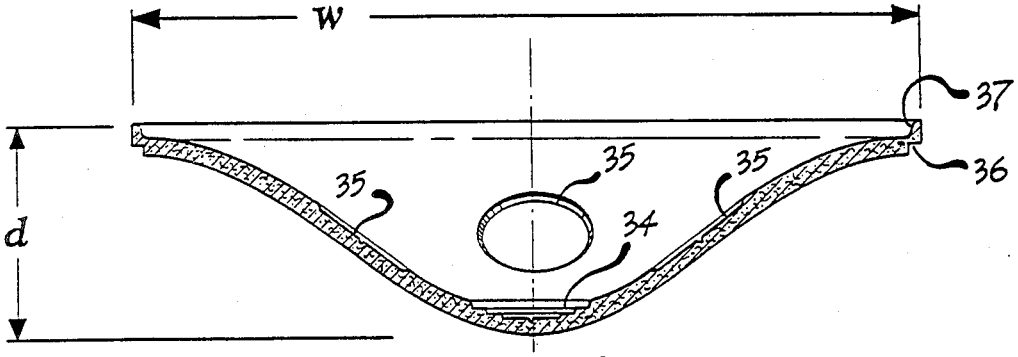

FIGS. 3 and 3*a* are perspective and cross sectional illustrations, respectively, of a preferred sinusoidally contoured acoustic tile useful in the embodiment of FIG. 2. In substance, each tile comprises a thin, contoured body of acoustic absorbing material, such as molded glass fiber, having a regular periphery 30, such as a square periphery, and a flat peripheral portion 31 adjoining the periphery for fitting into a two dimensional array such as a square grid. The interior portion 33 of the tile is contoured into a three dimensional shape generated from a full phase sine curve section rotated about an axis centered in the tile on the point of greatest amplitude. The surface thus formed can be referred to as a sinusoidal curveloid.

The depth of contour, d, of the curveloid is a function of the tile size and the octave band range to be controlled. A depth-to-width proportion (d:w) in excess of about one to ten, is a minimum ratio wherein the acoustic performance of the contoured tile is perceptibly better than a planar tile unit. A proportion in excess of about one to five produces a significantly improved performance; and, although greater depth would be desirable, a proportion of about one to two is close to a practical maximum which can be obtained with typical forming processes and common tile materials.

The height of the ceiling also poses a practical limitation on depth of contour. For low hung ceilings set at about eight feet, the depth of contour—irrespective of width—should exceed about 5 centimeters but not exceed 15 centimeters. For nine foot ceilings, the depth can be between 7.5 and thirty centimeters; and for higher ceilings, as are found in many industrial applications, even deeper tile contours can be used to trap and disperse machine sounds.

It should also be recognized that the depth of contour of tiles in one region of the ceiling can differ from the depth of contour of tiles in another region of the ceiling. Thus, for example, regions of the ceiling above noisy work zones, such as above typing pools or machines, can have tiles with a depth of contour greater than is used in other regions of the same ceiling overlying less noisy work zones.

Advantageously, the tile is formed with a plurality of regions of different thicknesses as by preferably forming it in a series of circular rings 34 of different thickness concentric with the central axis. Preferably the thickness of material lie within the range of about 1 to about 5 centimeters. These different thicknesses tend to disrupt the continuity of sound waves striking the tile, and the preferred circular rings also provide guides for cutting holes for the installation of lighting fixtures, sprinkler heads, speakers, ventilation vents and the like.

In addition a plurality of recessed circular regions 35 are advantageously molded at positions around the interior portion of the contoured region. These recessed regions serve the same purposes as rings 34.

Shoulders 36 can be provided on the upper edges of the formed tile for providing a guide for nesting into the grid 20 (of FIG. 2), and a projecting nesting lip 37 is provided for structural reinforcement during shipping, stacking and storage.

The tile are preferably made with square boundaries of one, two or four feet square for retrofitting on existing suspended ceiling grids. Alternatively, any other regular boundary, such as a hexagonal boundary, can be provided for fitting into the corresponding shaped regular openings of a support grid. In the case of a non-square periphery, the maximum horizontal dimension of the tile can be taken as the maximum width for purposes of applying the above recited proper proportions for the depth of contour.

C. MANUFACTURE OF TILES

These contoured acoustic tiles can be readily manufactured of mineral or glass fibers in blanket form. The blankets are first sprayed or impregnated with a thermosetting binder, such as S-548 heat resistant polyester with antimony oxide and then press molded to the desired contour at a temperature in the range of 300°-400° F. Suitable molding techniques are described, for example, in U.S. Pat. Nos. 3,239,973 and 3,581,453.

Advantageously, the resin binder may also include a pigment material for coloring the tile in the forming procedure, thereby producing a durable, nonchipping coloration and eliminating the need for spray painting.

A variety of accessories can be made for use in the ceiling system of the invention. Vacuum formed or section molded transparent plastic units of substantially the same size and shape as the respective tiles can be made for lighting lenses of diffusers, and similarly dimensioned units of plastic or metal with vents can be molded or stamped for providing ventilation, all while retaining the sound scattering and dispersing effects of the tile.

D. ADVANTAGES OF SYSTEM

The ceiling system of the invention has many advantages. Aesthetically it appears to the eye as a wavelike surface with a pleasant, continuous visual flow. Mechanically, the curved surface adds structural strength to the tile in much the same manner as the curvature of an egg shell. As a result, tile in accordance with the invention can be made using a wall thickness thinner than conventional planar acoustic tiles, while maintaining enhanced resistance to warpage and twisting.

The primary advantage of this ceiling system is that it significantly reduces noise as compared with conventional flat tile ceilings made of the same material. While applicant does not wish to be bound by theory, it is believed that three factors produce this reduction in noise. First, the three-dimensional form acts to break the organization of the reflected wave front, reducing the specular sound energy level by dispersing and scattering the wavefront. Second, the enlarged surface area of the contoured tile as compared with the area of flat tile achieves increased absorption. And, third, the preferred varied cross-sectional thickness tends to absorb sound over a broader spectrum of wavelengths than conventional tile of uniform thickness. Actual acoustical modeling tests have demonstrated that for sound in the frequency range of 2 to 16 kilohertz, ceiling systems made of such contoured tiles have an effective noise reduction coefficient more than 50% greater than that of a conventional planar ceiling of the same material.

The contour of the tile unit also produces several functional advantages. A space behind each tile unit is created below the hung ceiling support grid. This space can be used as a container for additional material, such as glass fiber, to increase both acoustic absorption and thermal insulation. Alternatively, this space can be used as a housing for lighting fixtures, including bulky but efficient sodium and mercury vapor fixtures. The convex intrusion of the tile also produces light dispersion, and the convex form provides a number of surfaces to mount conventional recessed lighting fixtures to have unique and specialized functions such as lighting for paintings, photos or murals; directional lighting with no visible source; omni-directional lighting, and angular lighting directed toward work surfaces in a proper direction to minimize shadows.

Similarly, the contoured tiles permit positioning loud speakers for more uniform distribution of sound with fewer speakers.

In addition, the contoured tile makes an ideal louvered vent for the distribution of heated and cooled air.

The advantage of using the same contoured tile form for lighting lenses, vents, and acoustic tiles is that the forms function to disperse sound even through not all surfaces are absorbtive. Moreover, they retain visual continuity and a perceptually soft flowing surface, complimenting the hard and rectlinear form of most commercial furniture and equipment.

E. ALTERNATIVE EMBODIMENT (FIGS. 4 AND 4*a*)

Figure 4:
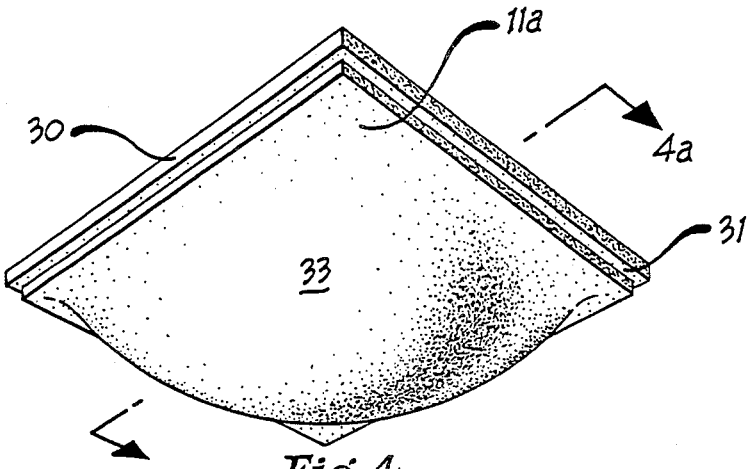
FIGS. 4 and 4*a* are perspective and cross sectional views of an alternative spherical form of a contoured tile useful in the system of FIG. 2.
Figure 4A:
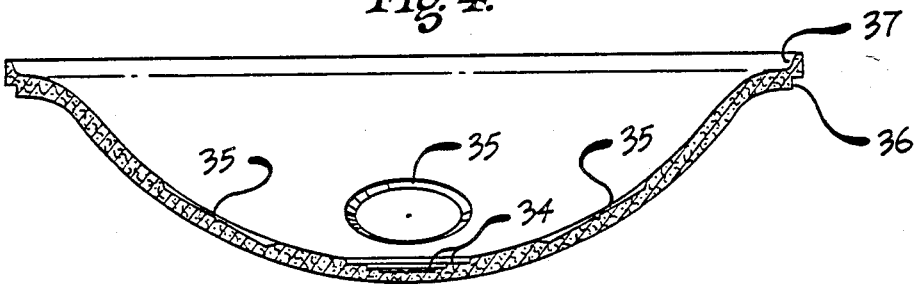

FIGS. 4 and 4*a* illustrates an alternative form of a tile useful in the embodiment of FIG. 2. It differs from the tile of FIG. 3 primarily in that the convex contoured region is predominantly spherical in configuration. Specifically, the contoured region is substantially in the form of a spherical segment of one base. This configuration is made and used in substantially the same way as the FIG. 3 embodiment to produce a somewhat less efficient acoustic ceiling having a different aesthetic effect, i.e. a drape-like pattern rather than a wave-like pattern. The proportion depth of contour to width should be greater than about 1:10 and preferably is greater than 1:5.

F. SECOND ALTERNATIVE EMBODIMENT (FIGS. 5 AND 5*a*)

Figure 5:
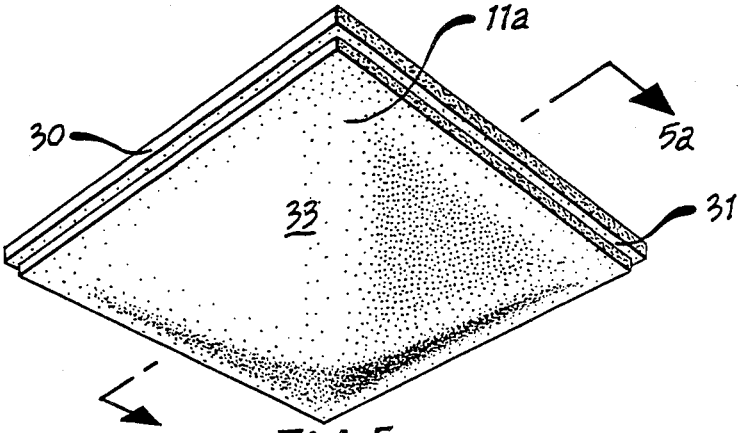
FIGS. 5 and 5*a* are views of an alternative pyramidal form of a contoured tile useful in the system of FIG. 2.
Figure 5A:
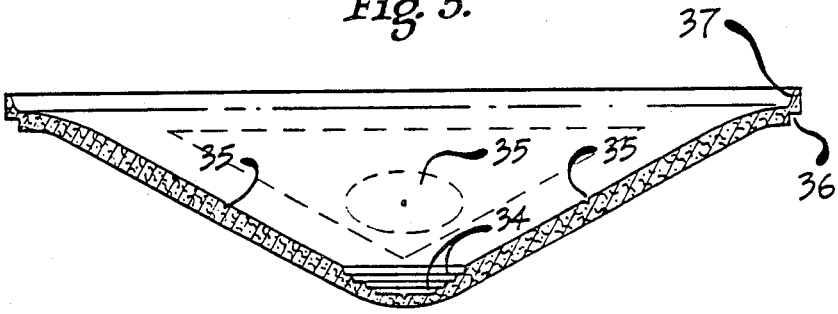

FIGS. 5 and 5*a* illustrate a second alternative form of a tile useful in the embodiment of FIG. 2. Here the contoured region is in the form of a square based pyramid with all edges radiused to about four inches so that a minimum of about 50% of the pyramid surface is curved in order to effectively disperse a significant wavefront in an omni-directional fashion. The proportion of depth of contour to width should be greater than 1:10 and preferably is greater than 1:5.

While the invention has been described in connection with but a small number of specific embodiments, it is to be understood that these are merely illustrative of many other specific embodiments which also utilize the principles of the invention. Thus numerous and varied devices can be made by those skilled in the art without departing from the spirit and scope of the present invention.

What is claimed is:

1. An acoustic tile ceiling system comprising:

a suspended ceiling structural grid adapted to hold a plurality of individual acoustic tile elements;

a pluraliity of smoothly contoured acoustic tile elements, each tile element having a surface thereof adapted to form a ceiling surface when installed within said ceiling structural grid;

said tile element surface exhibiting a curvature substantially as a surface of revolution varying smoothly and without abrupt changes from a substantially horizontal aspect at the periphery of said tile element through an increasingly downwardly projecting curvature to an inflection point through a decreasingly downwardly projecting curvature to a central, substantially horizontal portion, depressed at least 5 centimeters below the peripheral portion;

each said tile element forming in the composite with adjacent tile elements as installed in said structural grid, a substantially continous smoothly flowing curvature, particularly adapted to disperse long wave length audible sound.

2. An acoustic ceiling system according to claim 1 wherin each said tile has a maximum width and the ratio of said depth of contour to said maximum width is in excess of about 1:10.

3. An acoustic ceiling system according to claim 1 wherein each said tile has a maximum width and the ratio of said depth of contour to said maximum width is in excess of about 1:5.

4. An acoustic ceiling system according to claim 1 wherein each said tile comprises a plurality of regions of different thickness.

5. An acoustic ceiling system according to claim 1 wherein each said tile comprises a plurality of regions of different thickness in the range between 1 and 5 centimeters.

6. An acoustic ceiling system according to claim 1 wherein each said tile comprises a plurality of circular rings of different thickness.

7. An acoustic ceiling system according to claim 1 wherein each said tile includes a plurality of recessed circular regions of reduced thickness disposed about said convex interior portion.

8. An acoustic ceiling system according to claim 1 wherein each said acoustic tile has a projecting lip about the periphery for providing structural support during stacking.

9. An acoustic ceiling system according to claim 1 further comprising a grid having regular openings for receiving and supporting said tiles and said tiles having a regular peripheral boundary region fro fitting within said grid.

10. An acoustic ceiling system according to claim 1, 2, 3, 4, 5, 6, 7, 8 or 9 wherein each said contoured interior portion is substantially in the form of a sinusoidal curveloid.

11. An acoustic ceiling system according to claim 1, 2, 3, 4, 5, 6, 7, 8 or 9 wherein each said contoured interior portion is substantially in the form of a spherical segment.

12. An acoustic ceiling system according to claim 1, 2, 3, 4, 5, 6, 7, 8 or 9 wherein each said contoured interior portion is substantially a surface of revolution having slightly flattened sides in the form of a curvaloid pyramid having at least 50% of its surface curved.

13. An acoustic ceiling tile for placement in a suspended ceiling structural grid comprising:

a contoured body of acoustic absorbing material having a maximum width and a normally downwardly facing surface;

said normally downwardly facing surface exhibiting a curvature substantially as a surface of revolution varying smoothly and without abrupt changes from a substantially horizontal aspect at the periphery of the body through an increasingly downwardly projecting curvature to an inflection point through a decreasingly downwardly projecing curvature to a central, substantially horizontal portion, depressed at least 5 centimeters below the peripheral portion;

said body adapted to form, in conjunction with adjacent bodies when installed in said structural grid, a substantially continuous, smoothly flowing surface curvature particularly adapted to disperse long wave length audible sound.

14. An acoustic ceiling tile according to claim 13 wherein the ratio of said depth of contour to said maximum width is in excess of about 1:5.

15. An acoustic ceiling tile according to claim 13 wherein said tile comprises a plurality of regions of different thickness.

16. An acoustic ceiling tile according to claim 13 wherein said tile comprises a plurality of regions of different thickness in the range between 1 and 5 centimeters.

17. An acoustic ceiling tile according to claim 13 wherein said tile comprises a plurality of circular rings of different thickness.

18. An acoustic ceiling tile according to claim 13 wherein said tile comprises a plurality of recessed circular regions of reduced thickness disposed about said convex interior portion.

19. An acoustic ceiling tile according to claim 13 wherein said acoustic tile has a projecting lip about the periphery for providing structural support during stacking.

20. An acoustic ceiling tile according to claim 13 further comprising a regular peripheral boundary region.

21. An acoustic ceiling tile according to claim 13, 14, 15, 16, 17, 18, 19 or 20 wherein said contoured interior portion is substantially in the form of a sinusoidal curveloid.

22. An acoustic ceiling tile according to claim 13, 14, 15, 16, 17, 18, 19 or 20 wherein said contoured interior portion is substantially in the form of a spherical segment.

23. An acoustic tile according to claim 13, 14, 15, 16, 17, 18, 19 or 20 wherein said contoured interior portion is substantially a surface of revolution having flattened sides in the form of a pyramid having at least 50% of its surface curved.

24. An acoustic tile ceiling system according to claim 1 wherein said tile elements exhibit a step shaped edge for structural grid engagement and permitting tile surface orientation below said grid to form said substantially continuous smoothly flowing surface curvature between bodies adjacently supported in said grid.

25. An acoustic ceiling tile according to to claim 13 wherein said body exhibits a step shaped edge for structural grid engagement permitting body surface orientation below said grid to form said substantially continuous smoothly flowing surface curvature between bodies adjacently supported in said grid.

* * * * *

UNITED STATES PATENT AND TRADEMARK OFFICE

CERTIFICATE OF CORRECTION

PATENT NO. : 4,393,631

DATED : July 19, 1983

INVENTOR(S) : Edward D. Krent

It is certified that error appears in the above—identified patent and that said Letters Patent is hereby corrected as shown below:

Column 1, lines 35-36, "Such longer wavelength sound," should read --Such sound,--

Signed and Sealed this

*Thirty-first* Day of *January 1984*

[SEAL]

*Attest:*

GERALD J. MOSSINGHOFF

*Attesting Officer*

*Commissioner of Patents and Trademarks*